US006672196B1

(12) United States Patent
Ang

(10) Patent No.: US 6,672,196 B1
(45) Date of Patent: Jan. 6, 2004

(54) SELF-COMPENSATING SPADE ASSEMBLY

(75) Inventor: Teoh Hwa Ang, St. Nicholas View (SG)

(73) Assignee: Ordinance Development and Engineering Company of Singapore (1996) Pte Ltd. (SG)

( * ) Notice: Subject to any disclaimer, the term of this patent is extended or adjusted under 35 U.S.C. 154(b) by 0 days.

(21) Appl. No.: 10/181,192

(22) PCT Filed: Nov. 23, 2000

(86) PCT No.: PCT/SG00/00203

§ 371 (c)(1),
(2), (4) Date: Jul. 11, 2002

(87) PCT Pub. No.: WO01/51874

PCT Pub. Date: Jul. 19, 2001

(30) Foreign Application Priority Data

Jan. 12, 2000 (SG) ..... 200000096

(51) Int. Cl.[7] ..... F41A 23/00
(52) U.S. Cl. ..... 89/42.02
(58) Field of Search ..... 89/42.02, 41.01, 89/43.01

(56) References Cited

U.S. PATENT DOCUMENTS

| | | | | | |
|---|---|---|---|---|---|
| 682,072 | A | | 9/1901 | Haussner | |
| 901,401 | A | * | 10/1908 | Voller | 89/42.01 |
| 1,119,629 | A | * | 12/1914 | Voller | 89/40.01 |
| 1,183,242 | A | * | 5/1916 | Schneider | 89/42.02 |
| 1,297,445 | A | * | 3/1919 | Christie | 89/42.02 |
| 2,104,015 | A | * | 1/1938 | Beardsley | 89/42.02 |
| 2,425,783 | A | | 8/1947 | Buquor | 89/40 |
| 2,818,781 | A | * | 1/1958 | Ruf | 89/40.02 |
| 4,084,777 | A | * | 4/1978 | Lambert | 248/287.1 |
| 4,424,985 | A | * | 1/1984 | Holmes | 280/766.1 |
| 4,489,639 | A | * | 12/1984 | Winkler et al. | 89/37.01 |
| 6,000,313 | A | * | 12/1999 | Becker et al. | 89/40.02 |
| 6,092,975 | A | * | 7/2000 | Cannon et al. | 414/563 |
| 6,178,866 | B1 | * | 1/2001 | Searle et al. | 89/37.08 |

FOREIGN PATENT DOCUMENTS

| | | | |
|---|---|---|---|
| CH | 5346 | 5/1892 | |
| CH | 315151 | 9/1956 | |
| DE | 79826 | 3/1894 | |
| DE | 0388599 | 9/1990 | F41A/23/36 |
| DE | 19608455 | 9/1997 | F41A/23/32 |
| FR | 467980 | 2/1914 | |

* cited by examiner

*Primary Examiner*—Charles T. Jordan
*Assistant Examiner*—Jordan M Lofdahl
(74) *Attorney, Agent, or Firm*—Pennie & Edmonds LLP

(57) ABSTRACT

A spade assembly for use on an artillery vehicle compensates any gaps which would otherwise be formed between a ground supporting portion of the spade assembly and the soil. The length of the spade assembly is advantageously compensated to maintain the spade assembly in firm contact with the soil. This can increase the accuracy in the weapon in firing, and avoid violent displacement of the gun which can be caused when the spade assembly is not maintained firmly engaged with the earth.

21 Claims, 6 Drawing Sheets

SELF-COMPENSATING SPADE ASSEMBLY

FIELD OF THE INVENTION

The invention relates to spade assemblies suitable for use on artillery such as vehicle-mounted mortars and howitzers.

BACKGROUND OF THE INVENTION

In artillery vehicles such as mortars and howitzers, considerable recoil forces are generated as a fired projectile leaves the weapon mounted on the vehicle. The common approach in dealing with recoil forces is to fit so-called spade assemblies to the vehicle so that it is braced during firing.

The spade assemblies are typically arranged as two arms pivotally mounted to one side of the vehicle and positioned so that they penetrate the soil. This arrangement transfers recoil forces from the weapon to the ground, and discourages the vehicle from moving under the influence of recoil forces.

Many artillery vehicle are often relatively light in weight in relation to the significant recoil forces that can be generated during firing. In many cases, a weapon is mounted on a vehicle chassis or other wheeled structure which is easily displaced by recoil forces. Accordingly, spade assemblies are typically an important component of such vehicles or other wheeled structures.

The use of spade assemblies is associated with various shortcomings. During recoil, the spade assemblies tend to compress the soil on which they act, and the vehicle tends to return to its former position after firing. Accordingly, a gap is formed between the spade assembly and the soil.

Subsequent refiring causes the spade assembly to come into contact with the soil again, after the gap between the spade assemblies and the soil is closed. This can cause considerable stresses in the spade assemblies and in the structure of the vehicle mounting. These stresses can cause significant damage and possible failure if appropriate structural reinforcements are not provided.

Further, free-play between the spades and the soil can reduce the accuracy of firing. When low-fire rate accuracy is required, one approach has been to ure-layn the weapon to compensate for angular shifts of the vehicle after each firing.

It is an object of the invention to address these and other deficiencies associated with existing spade assembly arrangements.

SUMMARY OF THE INVENTION

The invention provides a self-compensating spade assembly suitable for use on a vehicle having a mounted weapon generating a recurring recoil force, the spade assembly including:

an elongate spade arm;

a spade mounting at one end of the spade arm for mounting the spade to the vehicle; and a ground contacting portion at the other end of the spade arm, the ground contacting portion including a support plate and a spade portion which are mutually positioned so that when the spade assembly is in use, the spade portion penetrates the earth on which the weapon is standing, and the support plate rests against the earth to at least partly transfer recoil forces from the weapon to the earth;

characterised in that the spade arm has a compensating means able to regulate the length of the spade arm to ensure that the ground contacting portion is generally maintained in firm contact with the earth on which the weapon is standing.

Preferably, the compensating means includes a telescopic engagement of two relatively slidable members defining a sealed chamber containing a source of hydraulic or pneumatic pressure which acts to bias the spade assembly in an extended position.

Preferably, the spade assembly can be maintained generally rigid in compression when the weapon is being repeatedly fired. Preferably, this is achieved by the use of an automatic locking arrangement which ensures that, during use, the length of the spade assembly can be increased but not decreased. Preferably, this is achieved by providing a hydraulically actuated system in which the volumes of distinct chambers are adjusted by regulating the flow from one chamber to the other, thus adjusting the relative position of the slidable members.

The invention further includes a vehicle having mounted thereon one or more spades according to the first aspect of the invention.

Preferably, two spade assemblies are used in combination to assist in stabilising a vehicle during recurrent firing. Preferably, the spade assemblies are in use angularly orientated at 40° below horizontal, and mutually positioned so that they define an included angle of 90°. This outwardly defined assists in stabilising the vehicle against recoil forces acting laterally as well as transversely of the weapon.

DESCRIPTION OF EMBODIMENT

Figure 1:
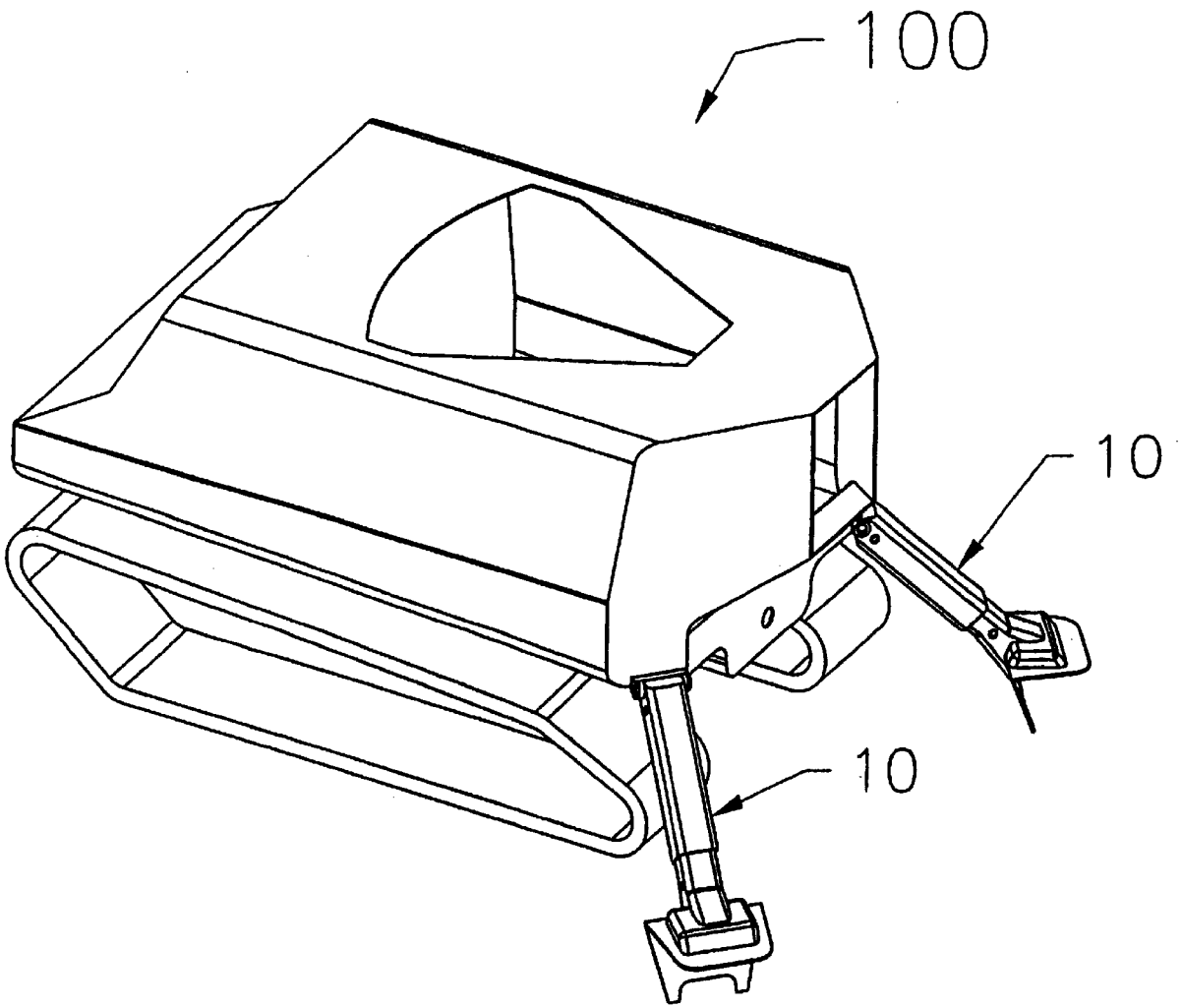
FIG. 1 is an isometric view of a vehicle fitted with self-compensating spades constructed in accordance with an embodiment of the invention.
Figure 2:
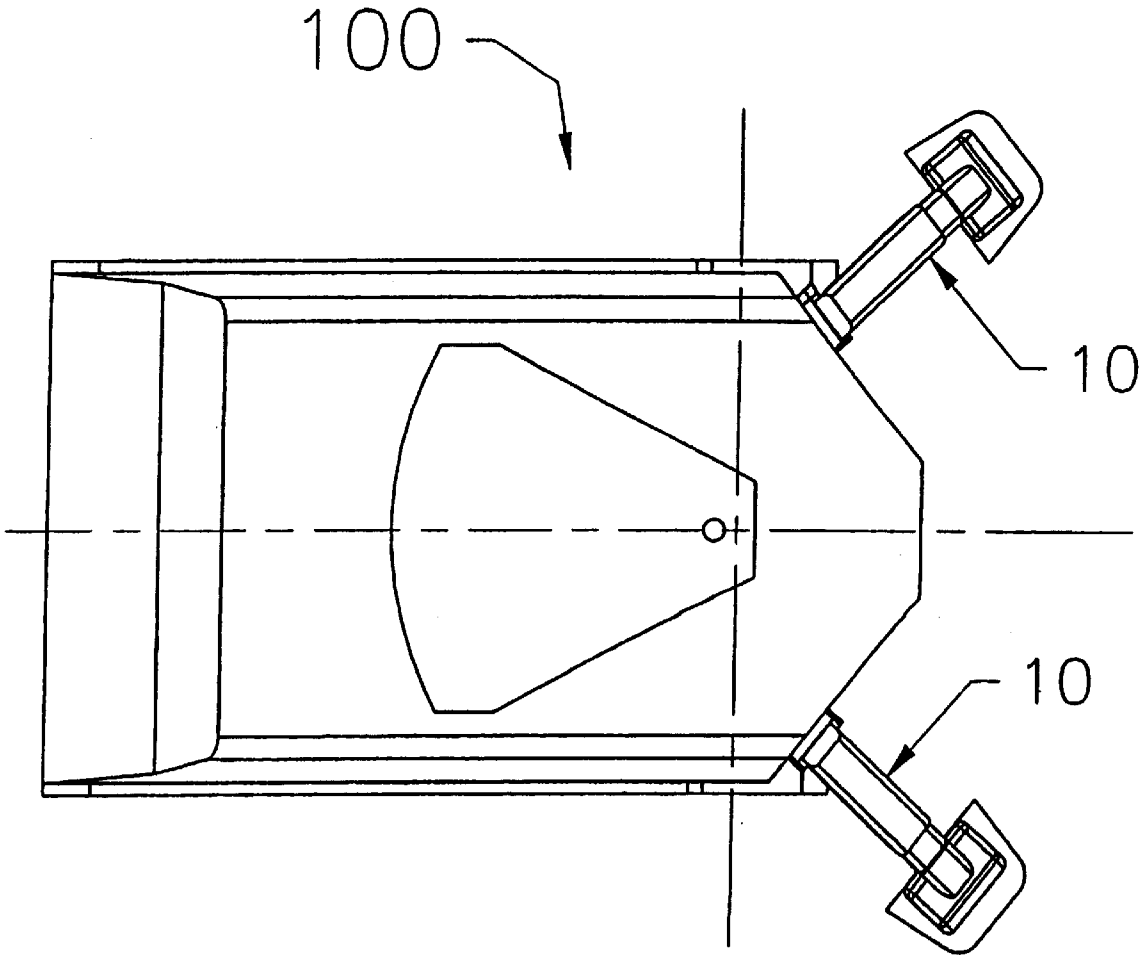
FIG. 2 is a plan view of the weapon shown in FIG. 1.

FIGS. 1 and 2 show compensating spade assemblies 10 pivotally attached at the rear of an artillery vehicle 100. The vehicle 100 is track-driven, and can have a weapon (not shown in FIGS. 1 and 2) mouted on an upper portion of the vehicle 100.

Stoppers on the vehicle 100 (also not shown in the drawings) determine the angular orientation of the spade assemblies 10 relative to the vehicle 100, when the spade assemblies 10 are moved into their downwardly extending position prior to use, as indicated in FIGS. 1 and 2. When the vehicle 100 is being driven or transported, the two generally identical spade assemblies 10 can be swung into a generally vertical position away from the ground.

Figure 3:
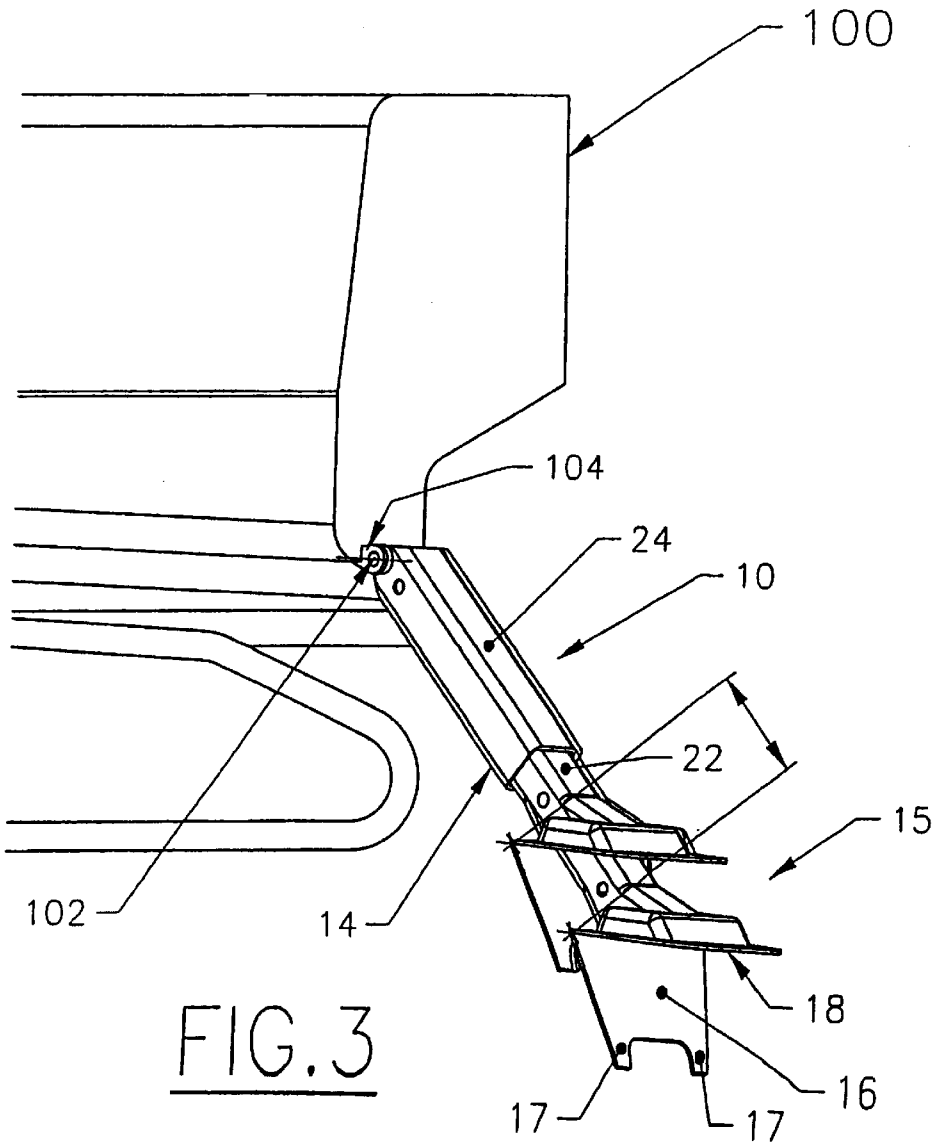
FIG. 3 is a partial side view of the weapon shown in FIG. 1, detailing one of the spade assemblies shown in FIG. 1.
Figure 4:
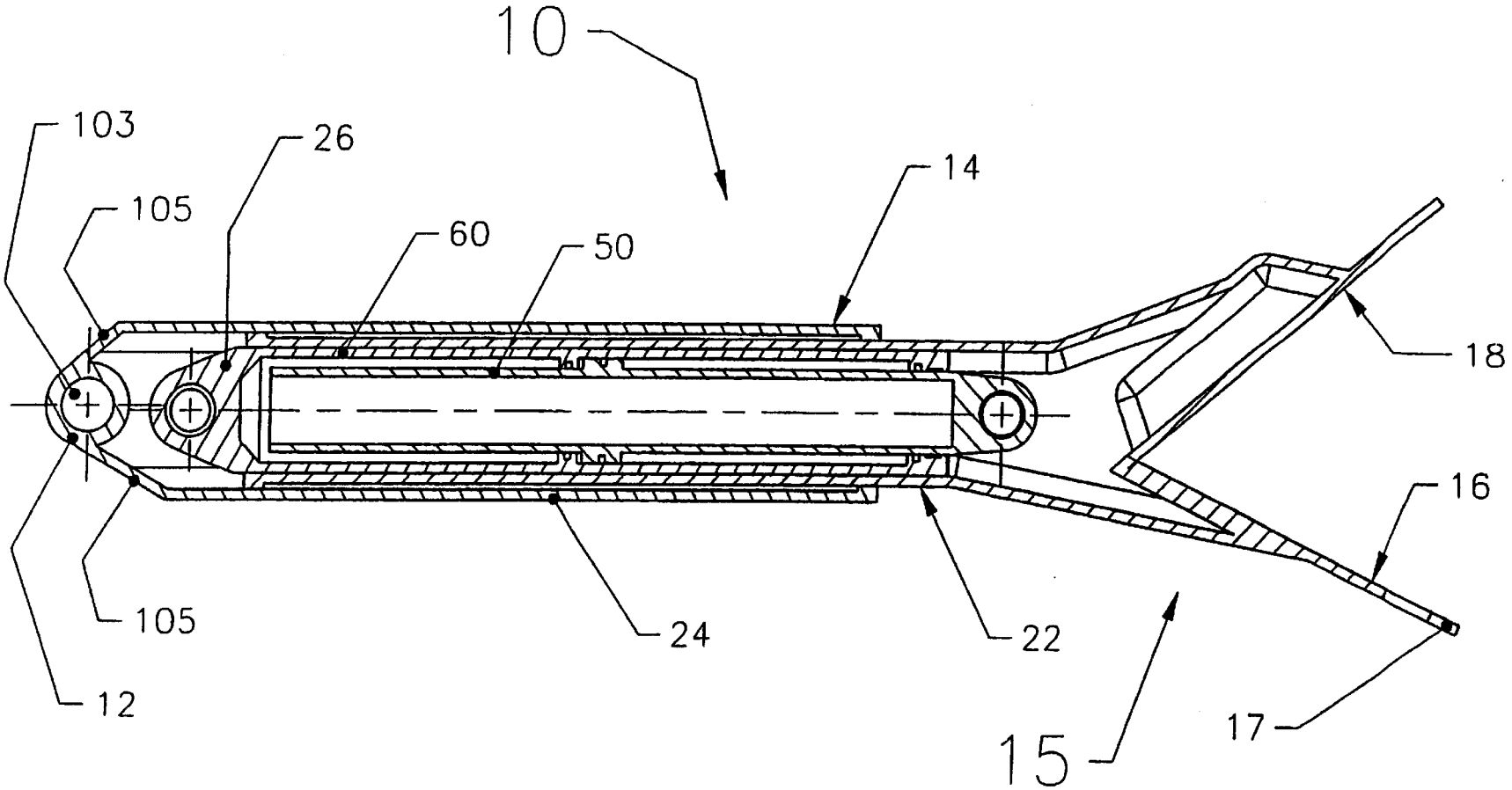
FIG. 4 is a cross-sectional drawing of one of the spade assemblies shown in FIG. 1.

FIGS. 3 and 4 show one of the compensating spade assemblies 10 in greater detail. In FIG. 3, it is seen that the spade assembly 10 has at one end a spade mounting 12 which, as illustrated more clearly in FIG, 4, includes a boss portion defining a circular opening 103 and having two side plates 105 as supports. A mounting pin 102 can be placed in the circular opening 103, to ensure that the spade assembly 10 is pivotally mounted to a mounting member 104 integrally or otherwise joined with the vehicle 100. This arrangement is shown in FIG. 3.

FIG. 4 shows a cross-sectional view of the spade assembly 10. The spade assembly 10 includes a spade mounting 12, a ground contacting portion 15, and a spade arm 14 joining the spade mounting 12 and the ground contacting portion 15. The ground contacting portion 15 has a spade portion 16 and a support plate or float 18. The ground contacting portion 15 contacts the ground and assists the spade assembly 10 to transfer forces from vehicle 100 to the ground. The spade mounting 12 allows the spade assembly to be mounted with a vehicle 100. The spade arm 14 can be adjusted in length as later described to provide the compensating action of the spade assembly 10.

The spade portion 16 and float 18 both have generally flat surfaces. The shape of the spade portion 16 is better shown in FIG. 3. The spade portion 16 is partially tapered towards its distal end which has two teeth 17. This tapered and toothed profile is designed to allow the spade portion 16 to embed into the earth with ease initially and readily engage relatively firm earth. The surface of float 18 is generally flat and rectangular in profile. In use, the ground contacting portion 15 of the compensating spade 10 generally operates in the same way as a conventional spade used on artillery vehicles.

The spade assembly 10 includes an outer housing 24 and inner sleeve 22. The outer housing 24 and inner sleeve 22 are telescopically displaceable so that the length of the arm portion 14 can be adjusted, to provide a compensating action as later discussed. As indicated in FIG. 3, the housing 24 and sleeve 22 both have a cross-sectional profile which is generally rectangular.

Within the spade assembly 10 there is a compensating cylinder 26 including a tubular piston 50 and a cylinder housing 60. The cylinder housing 60 is attached with the outer housing 24 and the tubular piston 50 is attached with the inner sleeve 22. In this way, the relative longitudinal displacement of the outer housing 24 and the inner sleeve 22 and thus the length of the spade assembly 10 can be regulated in a predetermined manner by the action of the compensating cylinder 26 as later described.

The cylinder housing 60 and tubular piston 50 of the compensating cylinder 26 are sealingly engaged so as to be relatively slidable. The tubular piston 50 extends into the cylinder housing 60 through an opening 52 in an open end of the housing 60. The cylinder housing 60 and tubular piston 50 define a cylinder chamber 30 filled with pressurised nitrogen gas ($N_2$).

The pressurised gas biases the compensating cylinder 26 towards an extended position, that is with the tubular piston 50 and cylinder housing 60 longitudinally displaced from each other so that the length of the spade assembly 10 is maximised. That is, in the absence of external forces, the pressurised gas acts to extend the length of the spade assembly 10.

The cylinder housing 60 and tubular piston 50 are respectively provided with a housing ring seal 56 and a piston ring seal 54. These ring seals 54, 56 divide the annular space between the housing 60 and tubular piston 50 into a first chamber 32 and a second chamber 38. A longitudinally oriented duct 34 is defined by a projection on part of the external surface of the cylinder housing 60. The duct 34 is positioned to allow oil to flow between the first chamber 32 and the second chamber 38, via valve mechanism 40 and aperture 36.

The action of the compensating cylinder 26 is regulated by a locking action which is automatically activated during repeated firing of the weapon, so that the length of the spade assembly 10 is predisposed to increase rather than decrease. This locking action is achieved using valve mechanism 40, which provides a hydraulically operated locking arrangement.

Figure 5:
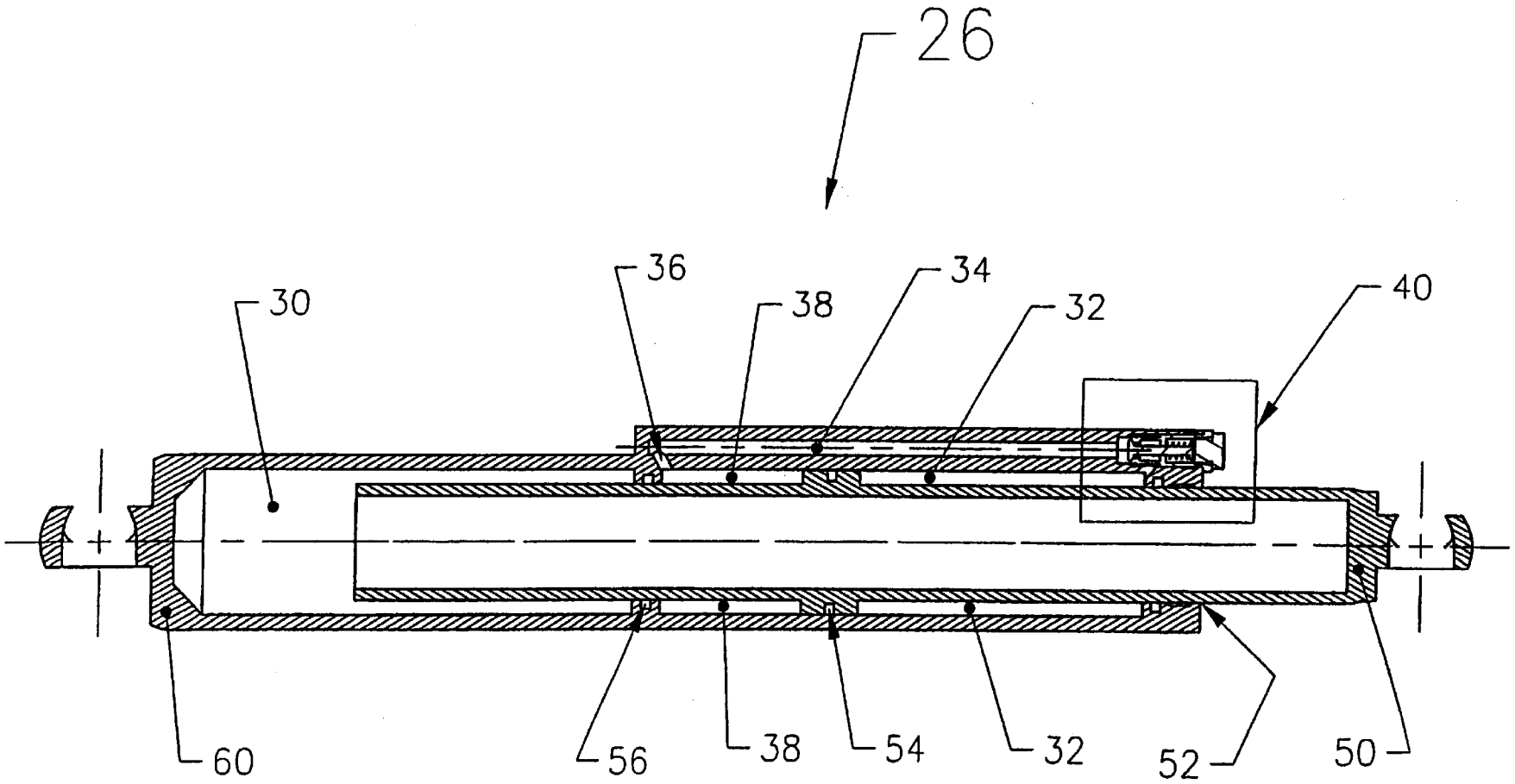
FIG. 5 is a side cross-sectional view of a compensating cylinder included as part of the spade assembly shown in FIGS. 1 and 2.

The valve mechanism 40 (indicated by the outlined box depicted in FIG. 5), connects the first chamber 32 with the duct 34, which is in fluid communication with the second chamber 38 via the aperture 36. The valve mechanism 40 regulates the flow of oil between these first and second chambers 32 and 38 through duct 34, and thus governs the relative positions of the cylinder housing 60 and tubular piston 50. The flow of oil between the two chambers 32, 38 adjusts the relative volumes of these chambers and accordingly adjusts the length of the spade assembly 10.

When the oil pressure in the first chamber 32 is higher than the oil pressure in the second chamber 38, the contacting portion 15 is generally retracted. As oil moves from the first chamber 32 to the second chamber 38, the volumes of the chambers 32, 38 adjust to accommodate the transfer of oil, so that as the spade assembly 10 progressively extends, the second chamber 38 reaches its maximal volume while the first chamber 32 reaches its minimal volume.

Figure 6:
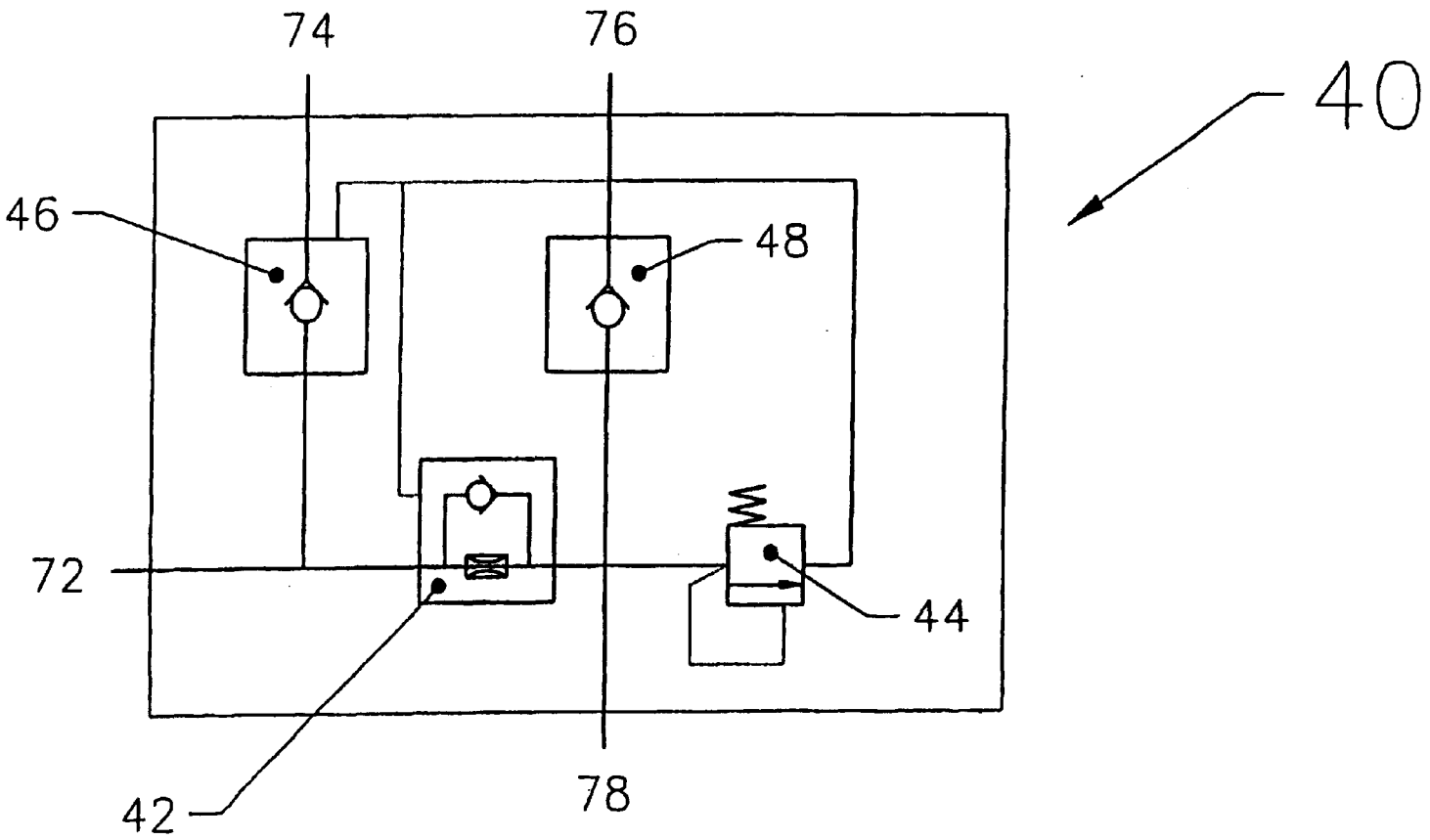
FIG. 6 is a schematic hydraulic circuit diagram of a valve mechanism included as part of the spade assembly shown in FIGS. 1 and 2.

The transfer of oil between the first and second chambers 32 and 38, and hence the adjustment in length of the spade assembly, is facilitated by the valve mechanism 40. The structure of the valve mechanism is shown schematically in FIG. 6. The valve mechanism 40 communicates with the first chamber 32 through opening 72. Oil flows from the first chamber 32 through one-way throttle valve 42 to the second chamber 38 through opening 78, as the compensating tubular piston 50 is progressively extended. Accordingly, the length of the cylinder 26 can be progressively extended, but is not retracted as the oil in the second chamber 38 cannot flow back to the first chamber 32 through the one-way throttle valve 42. The check valves 46 and 48 server to prevent the oil in chambers 38 and 32 from flowing out to openings 74 and 76 respectively. Any reduction of the amount of oil in the first chamber 38 (that is, leakage back through the one-way throttle valve 42 to the first chamber 32) is minimal as the recoil forces act only momentarily, for example, for around 100 milliseconds).

The valve mechanism 40 includes pilot-operated check valve 46 which allows oil to flow from the second chamber 38 to flow out through opening 74 so that the compensating cylinder 26 and hence the length of the spade assembly 10 can be retracted after use. This pilot-operated check valve 46 is operated by input oil pressure from the pilot line link to the opening for input opening 76, when it is required to retract the spade portions 16 at the end of a firing session. The input oil from opening 76 can freely flow through the check valve 48. This action can be used to retract the cylinder, by allowing oil to flow back into the first chamber 32 through opening 78. The valve will be closed by the pressure from the pilot line linked from opening 76 to prevent bypass of the input oil through the one-way throttle valve 42.

The opening 76 in the valve mechanism 40 can be used to input oil externally to the first chamber 32 to retract the tubular piston 50.

The pressure relief valve 44 discharges oil from the chambers when the oil in the first and second chambers 32 and 38 becomes overly pressurised due to thermal expansion of the oil. As the oil cools, replacement oil can be provided through opening 76 as appropriate.

In this way, the valve mechanism 40 allows relative displacement of the outer housing 24 and inner sleeve 22 so that the distance between the ground contacting portion 15 of the spade assembly 10 and the ground to be adjusted after firing. The compensating action provided by the compensating cylinder 26 allows the float 18 to be generally maintained in firm contact with the earth despite recurring firing of the weapon.

When the weapon is to be used, the vehicle 100 is driven into position, and the spade assemblies 10 pivotally located in their operative position. The vehicle 100 is reversed a small distance so that the spade portions 16 catch against, and are then embedded into the earth due to the motion of the vehicle 100 relative to the ground.

When the weapon is fired, recoil forces act to push the vehicle 100 backwards and downwards. However, the floats 18 and spade portions 16 act against the earth to prevent substantial movement of the vehicle 100, and the spade portions 16 prevent the spade assemblies 10 from dislodging from the earth. Though the outer housing 24 and inner sleeve 22 can be relatively adjusted, the valve mechanism 40 ensures that the spade assembly 10 is essentially rigid during firing. Of course, a small proportion of the recoil forces will be absorbed by the spade assembly 10, accompanied by a minimal shortening in the length of the spade assembly 10.

As some compaction of the soil will inevitably occur after firing, a gap between the float 18 and the earth is typically formed. As this occurs, or very shortly after it occurs, the length of the spade assembly 10 is increased by the compensating action of the outer housing 24 and inner sleeve 22 so that the float 18 is at most if not all times firmly engaged with the earth. Any gap formed between the float 18 and the earth is advantageously compensated so that the weapon is adequately braced before the next firing.

This action allows the vehicle to be maintained in firm contact with the soil to allow for more accurate firing, less stress on the spade assemblies 10 and vehicle chassis. Also, the vehicle 100 is not subject to violent surges in movement due to the recoil forces moving to close gaps formed between the float 18 and the soil.

What is claimed is:

1. A self-compensating spade assembly for use on a self-propelled vehicle having a mounted weapon for generating a recurring recoil force, the spade assembly comprising:

an elongate spade arm;

a spade mounting at one end of the spade arm for mounting the spade to the vehicle;

a ground contacting portion at the other end of the spade arm, the ground contacting portion comprising a support plate and a spade portion which are mutually positioned so that when the spade assembly is in use the support plate rests against the earth to at least partly transfer recoil forces from the weapon to the earth;

the spade arm having compensating means able to automatically biasing the spade assembly in an extended position to regulate the length of the spade arm and thus ensure that the ground contacting portion is generally maintained in firm and constant contact with the earth on which the vehicle is standing;

the compensating means including a telescopic engagement of two relatively slidable members; and a valve for regulating fluid communication between two distinct chambers during use of the self-compensating spade assembly to adjust the relative position of the two relatively slidable members.

2. The self-compensating spade assembly as claimed in claim 1, wherein the two relatively slidable members define a sealed chamber containing a source of pressure, the source of pressure being selected from the group consisting of hydraulic and pneumatic.

3. The self-compensating spade assembly as claimed in claim 1, comprising an automatic locking device to maintain the self-compensating spade assembly generally rigid in compression during firing of the weapon.

4. The self-compensating spade assembly as claimed in claim 2, comprising an automatic locking device to maintain the self-compensating spade assembly generally rigid in compression during firing of the weapon.

5. The self-compensating spade assembly as claimed in claim 3, wherein the valve means comprises a one-way valve and a check valve, the one-way valve acting to provide the generally rigid compression.

6. A vehicle having mounted thereon a plurality of self-compensating spade assemblies according to claim 1.

7. A vehicle having mounted thereon a plurality of self-compensating spade assemblies according to claim 2.

8. A vehicle having mounted thereon a plurality of self-compensating spade assemblies according to claim 3.

9. A vehicle having mounted thereon a plurality of self-compensating spade assemblies according to claim 5.

10. The vehicle as claimed in claim 6, wherein at least two spade assemblies act in combination to assist in stabilizing the vehicle during recurrent firing of the weapon at any desired bearing.

11. The vehicle as claimed in claim 7, wherein at least two spade assemblies act in combination to assist in stabilizing the vehicle during recurrent firing of the weapon at any desired bearing.

12. The vehicle as claimed in claim 8, wherein at least two spade assemblies act in combination to assist in stabilizing the vehicle during recurrent firing of the weapon at any desired bearing.

13. The vehicle as claimed in claim 9, wherein at least two spade assemblies act in combination to assist in stabilizing the vehicle during recurrent firing of the weapon at any desired bearing.

14. The vehicle as claimed in claim 10, wherein the spade assemblies are oriented generally outwardly from the vehicle to stabilize the vehicle when the weapon is fired at any desired bearing.

15. The vehicle as claimed in claim 11, wherein the spade assemblies are oriented generally outwardly from the vehicle to stabilize the vehicle when the weapon is fired at any desired bearing.

16. The vehicle as claimed in claim 12, wherein the spade assemblies are oriented generally outwardly from the vehicle to stabilize the vehicle when the weapon is fired at any desired bearing.

17. The vehicle as claimed in claim 13, wherein the spade assemblies are oriented generally outwardly from the vehicle to stabilize the vehicle when the weapon is fired at any desired bearing.

18. A spade assembly as in claim 1, wherein when on soft ground the spade portion penetrates the earth on which the weapon is standing and when on hard ground the spade portion presses tightly against the surface.

19. A vehicle having mounted thereon a plurality of self-compensating spade assemblies according to claim 18.

20. A vehicle as claimed in claim 19, wherein at least two spade assemblies act in combination to assist in stabilizing the vehicle during recurrent firing of the weapon at any desired bearing.

21. A vehicle as claimed in claim 20, wherein the spade assemblies are oriented generally outwardly from the vehicle to stabilize the vehicle when the weapon is fired at any desired bearing.

* * * * *